US009052163B2

(12) United States Patent
Weigand

(10) Patent No.: US 9,052,163 B2
(45) Date of Patent: Jun. 9, 2015

(54) ADJUSTABLE SCOPE MOUNT FOR A PROJECTILE WEAPON AND METHODS OF USING AND MAKING THEREOF

(71) Applicant: WEIGAND COMBAT HANDGUNS INC., Mountaintop, PA (US)

(72) Inventor: John C. Weigand, Mountaintop, PA (US)

(73) Assignee: WEIGAND COMBAT HANDGUNS INC., Mountaintop, PA (US)

( * ) Notice: Subject to any disclaimer, the term of this patent is extended or adjusted under 35 U.S.C. 154(b) by 0 days.

(21) Appl. No.: 13/963,680

(22) Filed: Aug. 9, 2013

(65) Prior Publication Data

US 2015/0040458 A1 Feb. 12, 2015

(51) Int. Cl.
*F41G 1/00* (2006.01)
*F41G 11/00* (2006.01)

(52) U.S. Cl.
CPC ..... *F41G 11/001* (2013.01); *F41G 11/003* (2013.01)

(58) Field of Classification Search
CPC ..... F41G 1/387; F41G 11/005; F41G 11/007
USPC ..... 42/111, 124, 125, 126, 135, 136, 138; 248/205.1
See application file for complete search history.

(56) References Cited

U.S. PATENT DOCUMENTS 681,202 A * 8/1901 De Zeng, Jr ..... 42/126
1,450,349 A 4/1923 Belding
1,926,151 A 9/1933 Jung
2,200,283 A 5/1940 Lennon
2,641,057 A 6/1953 Moore
2,663,083 A 12/1953 Harms
3,406,455 A 10/1968 Akin, Jr.
3,471,932 A 10/1969 Luning
4,317,304 A 3/1982 Bass
4,660,289 A 4/1987 Wilhide
5,086,566 A 2/1992 Klumpp
5,144,752 A 9/1992 Boeke et al.
5,274,941 A * 1/1994 Moore ..... 42/126
5,400,539 A 3/1995 Moore
5,428,915 A 7/1995 King (Continued)

OTHER PUBLICATIONS

Midway USA, Leatherwood Hi-Lux 3D Picatinny-Style Mount with 100 MOA Vertical Adjustment and Gross Horizontal Adjustment Fits Picatinny-Style Scope Base Matte, Product #617607, website product information, 3 pages, printed Aug. 9, 2013.

(Continued)

*Primary Examiner* — Gabriel Klein
(74) *Attorney, Agent, or Firm* — Rothwell, Figg, Ernst & Manbeck, P.C.

(57) ABSTRACT

An adjustable scope mount for a projectile weapon can include a base and a mounting piece pivotally attached to the base. The mounting piece can include a first bore that is substantially the same size as a first bore of the base and a second bore that is substantially the same size as a second bore of the base. The respective first bores of the base and mounting piece can be positioned such that when they completely overlap, the mounting piece is positioned at a first minute of angle setting. Likewise, the respective second bores of the base and mounting piece can be positioned such that when they completely overlap, the mounting piece is positioned at a second minute of angle setting. Related methods of using and manufacturing the adjustable scope mount are also described.

19 Claims, 11 Drawing Sheets

(56) References Cited

U.S. PATENT DOCUMENTS

| | | | | |
|---|---|---|---|---|
| 5,787,630 | A | 8/1998 | Martel | |
| 6,295,754 | B1 | 10/2001 | Otteman et al. | |
| 6,418,657 | B1 | 7/2002 | Brown | |
| 6,481,146 | B2 | 11/2002 | Carrier, III | |
| 6,591,538 | B2 * | 7/2003 | Holler | 42/125 |
| 6,705,037 | B2 | 3/2004 | Van Kirk | |
| 6,708,439 | B1 | 3/2004 | Laitala | |
| 6,732,987 | B2 | 5/2004 | Wooten et al. | |
| 6,772,550 | B1 | 8/2004 | Leatherwood | |
| 6,862,832 | B2 | 3/2005 | Barrett | |
| 7,543,405 | B1 | 6/2009 | Ivey | |
| 7,808,606 | B2 * | 10/2010 | Denda | 349/187 |
| 7,827,724 | B1 * | 11/2010 | Spinelli | 42/124 |
| 8,079,171 | B2 * | 12/2011 | Barrett | 42/125 |
| 8,240,075 | B1 * | 8/2012 | Mullin | 42/125 |
| 8,296,991 | B1 * | 10/2012 | Chung | 42/111 |
| 8,528,140 | B1 * | 9/2013 | Phillips et al. | 12/111 |
| 2013/0008073 | A1 * | 1/2013 | Clifton et al. | 42/125 |
| 2014/0123536 | A1 * | 5/2014 | Hamm et al. | 42/125 |
| 2014/0157648 | A1 * | 6/2014 | Haering | 42/125 |

OTHER PUBLICATIONS

Ivey Externally-Adjusting Scope Mounts for Ultra-Long Range Shooting, website product information dated Oct. 9, 2010, 4 pages.

Variable Gantry Mount, website product information, http://vgmount.com/, printed Aug. 9, 2013, 3 pages.

Montana Vintage Arms, Malcolm Mounts, website product information, http://www.montanavintagearms.com/mva_malcom.html, printed Aug. 9, 2013, 2 pages.

Riflescopes, Hawke 1 piece 1 inch, Adjustable MOA Rings/Base (HM7220), website product information, 1 page, printed Aug. 9, 2013.

* cited by examiner

ADJUSTABLE SCOPE MOUNT FOR A PROJECTILE WEAPON AND METHODS OF USING AND MAKING THEREOF

BACKGROUND

1. Field

The present invention relates to an improved adjustable scope mount for a projectile weapon and methods of using and making thereof.

2. Background

Telescopic sights are often used with firearms to allow for improved aiming. Many types of sights, such as rifle scopes, include separate adjustment controls for adjusting the horizontal and/or the vertical alignment of the scope. These adjustments can be used to account for wind and projectile drop due to gravity. In some situations, such as certain long-range shots, large vertical adjustments may be required. Although such vertical adjustments can be made by the scope itself, in some situations, it may be desirable to attach the scope to an adjustable scope mount in order to position the scope at a desired angle. There is a continuing need for improved adjustable scope mounts, such as the adjustable scope mounts described herein.

SUMMARY

In some embodiments, an adjustable scope mount for a projectile weapon can include a base including a first bore and a second bore, and a mounting piece pivotally attached to the base. The mounting piece can include a first bore that is substantially the same size as the first bore of the base, and a second bore that is substantially the same size as the second bore of the base. The first bore of the base and the first bore of the mounting piece can be positioned such that when the first bore of the base and the first bore of the mounting piece are aligned to completely overlap, the mounting piece is positioned at a first minute of angle setting. The second bore of the base and the second bore of the mounting piece can be positioned such that when the second bore of the base and the second bore of the mounting piece are aligned to completely overlap, the mounting piece is positioned at a second minute of angle setting.

In some embodiments, a method of using an adjustable scope mount for a projectile weapon can include aligning the first bore of the base with the first bore of the mounting piece to completely overlap. The method can further include inserting the bore pin into the first bore of the base and the first bore of the mounting piece to secure the mounting piece at the first minute of angle setting.

In some embodiments, a method of manufacturing an adjustable scope mount for a projectile weapon can include forming a first bore in a base, forming a second bore in the base, forming a first bore in a mounting piece that is substantially the same size as the first bore of the base, forming a second bore in the mounting piece that is substantially the same size as the second bore of the base, and attaching the mounting piece to the base such that the mounting piece can pivot with respect to the base to allow the scope mount to be adjusted to different minute of angle settings. The first bore of the base and the first bore of the mounting piece can be positioned such that when the first bore of the base and the first bore of the mounting piece are aligned to completely overlap, the mounting piece is positioned at a first minute of angle setting. The second bore of the base and the second bore of the mounting piece can be positioned such that when the second bore of the base and the second bore of the mounting piece are aligned to completely overlap, the mounting piece is positioned at a second minute of angle setting.

These and other embodiments and advantages of the present invention will become apparent from the following detailed description, taken in conjunction with the accompanying drawings, illustrating by way of example the principles of the invention.

BRIEF DESCRIPTION OF THE DRAWINGS

In order to facilitate a fuller understanding of the exemplary embodiments, reference is now made to the appended drawings. These drawings should not be construed as limiting, but are intended to be exemplary only.

DETAILED DESCRIPTION

The following description is intended to convey a thorough understanding of the embodiments described by providing a number of specific embodiments and details relating to adjustable scope mounts and methods of using and making thereof. It should be appreciated, however, that the present invention is not limited to these specific embodiments and details, which are exemplary only. It is further understood that one possessing ordinary skill in the art would appreciate the use of the invention for its intended purposes and benefits in any number of alternative embodiments, depending upon specific design and other needs.

As described above, conventional weapon scopes are often designed to allow adjustment in horizontal (windage) and vertical (elevational) directions. In certain situations, such as when shooting lower velocity ammunition, there is a risk that the scope can run out of elevational adjustment, such as for example, when using a lower velocity projectile at long distances. In these cases, it may be desirable to attach the scope to an adjustable scope mount as the projectile's point of impact may be too low for compensation by the scope alone.

Figure 1:
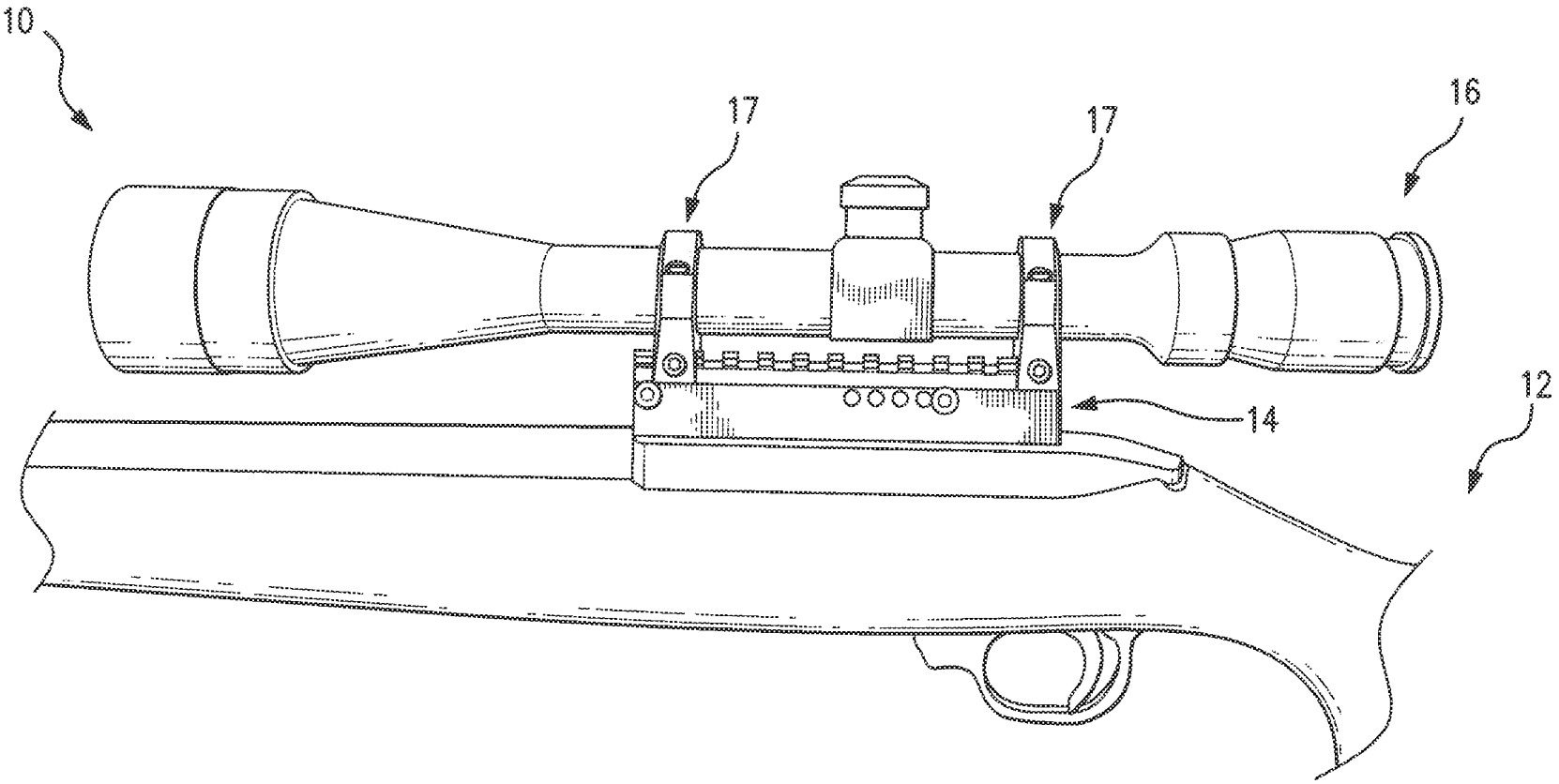
FIG. 1 illustrates a front view of a projectile weapon system including a scope, an adjustable scope mount, and a projectile weapon in accordance with one embodiment.

The adjustable scope mounts described herein can, for example, be used to elevate the scope at a desired angle to reduce the risk of the scope running out of adjustment. For example, FIG. 1 illustrates a front view of projectile weapon system 10, including a projectile weapon 12, an adjustable scope mount 14, and a scope 16. Projectile weapon 12 can be any suitable weapon designed to fire a projectile. For example, as illustrated in FIG. 1, projectile weapon 12 can be in the form of a rifle. Alternatively, weapon 12 can, for example, be in the form of a suitable pistol, shotgun, air gun, air soft gun, bow and arrow, cross-bow, or the like.

Scope 16 can, for example, be any suitable type of weapon sight designed to facilitate aiming. For example, scope 16 can be in the form of an optical telescopic sight, such as the scope shown in FIG. 1. In some embodiments, scope 16 can, for example, be in the form of a suitable laser sight, reflector sight, or iron sight. In some embodiments, scope 16 can include multiple sights, such as multiple optical telescope sights, or multiple different types of sights, such as an optical telescope sight and a laser sight integrated into a single housing.

Mount 14 can, for example, be in the form of a substantially rectangular block containing a substantially L-shaped base 18 extending in a longitudinal direction (see, e.g., FIGS. 11-15) and a corresponding L-shaped mounting piece 20 extending in the longitudinal direction (see, e.g., FIGS. 16-20). As described further herein, mounting piece 20 can be pivotally attached to base 18 at one or more pivots, such as via a pivot pin 22.

Mount 14 can be designed to be mounted to weapon 12 such that mount 14 extends in a longitudinal direction, such as along a firing barrel of weapon 12. In situations where weapon 12 does not include such a barrel, mount 14 can otherwise be configured to extend in a firing direction of weapon 12. Mount 14 can, for example, be attached to weapon 12 via a bottom surface of mount 14.

Mount 14 can be designed to be mounted to scope 16 such that scope 16 extends in a longitudinal direction, such as along a firing barrel of weapon 12. In situations where weapon 12 does not include such a barrel, mount 14 can otherwise be configured to position scope 16 to extend in a firing direction of weapon 12. Mount 14 can be attached to weapon 12 via a bottom surface of mount 14. In some embodiments, scope 16 can for example be secured to mount 14 via one or more attachments, such as through the use of one or more scope rings 17 attached to mount 14.

As described further herein, mount 14 can be configured such that it can be adjusted and fixed at a desired position to elevate a front end of scope 16 at a desired angle. For example, in the context of a firearm, mount 14 can provide an adjustable angle between the centerline of the scope and the centerline of the firing barrel. This can allow for a coarse aim adjustment of the firearm without adjustment of the scope itself. In practice, a user can use mount 14 to get a coarse point of impact adjustment and then use elevational adjustment controls on the scope itself to fine tune an exact point of impact adjustment. In some embodiments, mount 14 can be configured to allow for horizontal adjustment, such as, for example, by being positioned on a lateral side of weapon 12. In some embodiments, mount 14 can be configured to allow for both vertical and horizontal adjustment.

One or more parts of mount 14 can be made entirely or partially from suitable aluminum, steel, alloys, plastics, or one or more other suitable materials. The choice of materials for the parts described herein can be informed by the requirements of mechanical properties, temperature sensitivity, moldability properties, or any other factor apparent to a person having ordinary skill in the art.

Figure 2:
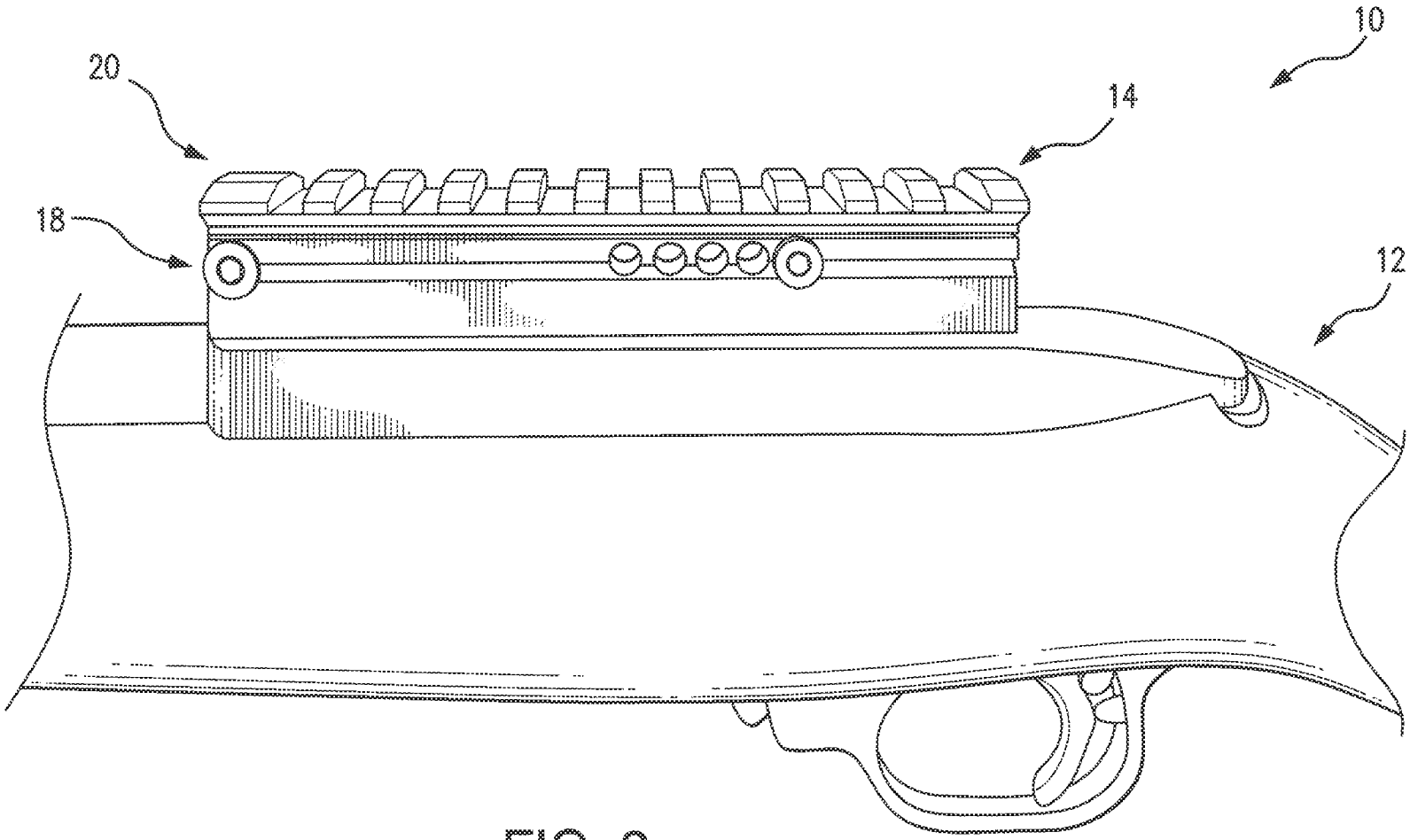
FIG. 2 illustrates a front view of the projectile weapon system of FIG. 1 without an attached scope.

FIG. 2 illustrates a front view of projectile weapon system 10 including mount 14 mounted to weapon 12 without scope 16 attached.

Figure 3:
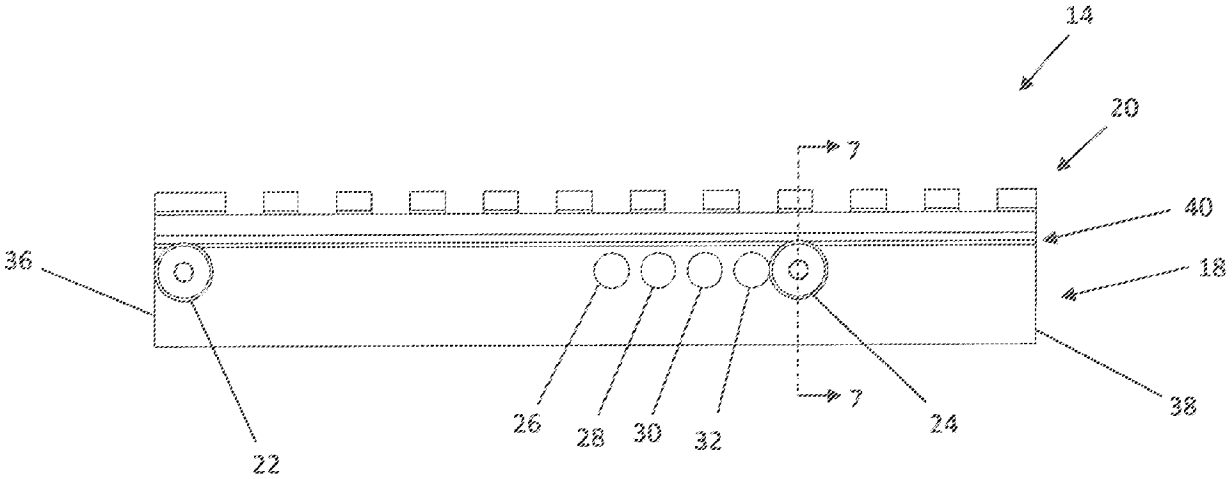
FIG. 3 illustrates a front view of the mount of FIG. 1 in a first setting.
Figure 4:
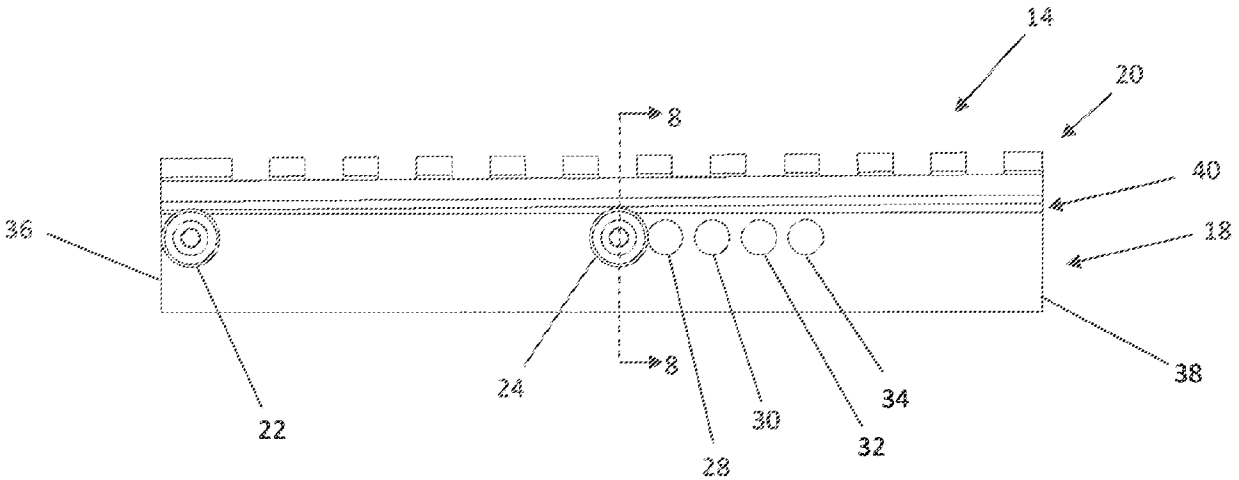
FIG. 4 illustrates a front view of the mount of FIG. 1 in a second setting.

FIGS. 3 and 4 illustrate front views of mount 14 in a first setting (FIG. 3) and in a second setting (FIG. 4). As described further below, in some embodiments, mounting piece 20 and base 18 can be secured together via a bore pin 24 (or a plurality of bore pins) and a pivot pin 22 (or a plurality of pivot pins) to secure mount 14 at one or more desired MOA settings. For example, the embodiment of mount 14 illustrated in FIGS. 3 and 4 includes five bore holes formed in base 18 (first bore 26, a second bore 28, a third bore 30, a fourth bore 32, and a fifth bore 34). The bores of base 18 can be positioned and sized to correspond to bores formed in mounting piece 20 (shown, for example, in FIG. 18). Pivot pin 22 is illustrated as being positioned near side 36 of mount 14, but may be positioned at another suitable position, such as for example at a suitable position in the middle of mount 14 or near side 38.

One or more of the various bores of base 18 can be substantially the same size as one or more of the various bores of mounting piece 20. Corresponding bores of mounting piece 20 and base 18 can be positioned such that when the bores are aligned to completely overlap, mounting piece 20 is positioned at a respective minute of angle setting. The term minute of angle ("MOA") is widely used in the shooting industry and refers to the dividing of one degree of angle into sixty minute intervals. Each minute of angle is approximately 0.16666 of a degree. Depending on several factors, at 100 yards, a 1 MOA change can, for example, result in a 1-inch change up or down in the point of impact. Likewise, at 100 yards, a 20 MOA change can, for example, result in a 20-inch point of impact adjustment. Corresponding impact adjustments for given MOA settings are based on many factors and can be determined, for example, through calculations, and/or through field testing with the mount. In view of the above, the desired angle of an adjustable scope mount can be selected such that a desired point of aim for a given distance coincides with the scope being centered. The use of mounts described herein can therefore reduce the risk of the scope running out of elevational adjustment.

In addition, the use of an adjustable scope mount, such as mount 14, with a base and mounting piece being securely fixed together by a bore pin and a pivot pin in a discrete MOA setting, can allow the mount to be stable and secure enough to withstand the extremely large forces expected during the use of firearms and other projectile weapons. Generally speaking, the greater the number of movable parts in an adjustable scope mount (such as existing adjustable scope mounts that include various springs and adjustment screws), can create additional points of failure in the scope mount and lead to undesired vibration and/or movement between the base and mounting piece. As described above, small variations in the position of the mounting piece relative to the base might undesirably affect the precision and/or accuracy of the scope. It is therefore appreciated that a scope mount having discrete adjustment settings, such as through the use of a positive stop tightened bore pin secured within substantially identically sized bores formed in the base and mounting piece, will allow the mount to be fixed in a discrete MOA setting and thereby prevent the mount from losing its position, even if the mount is bumped or banged.

FIG. 3 illustrates mount 14 secured in a first MOA setting with bore pin 24 disposed in fifth bore 34. As described further herein, mount 14 can allow for multiple adjustment settings. For example, in some embodiments, mount 14 can include three separate adjustments settings (such as 0 MOA, 10 MOA and 20 MOA). A small gap 40 may be formed between a surface of base 18 and a corresponding surface of mounting piece 20. FIG. 3 illustrates gap 40 having a uniform size between side 36 and side 38, which in this embodiment indicates that mount 14 is at a 0 MOA setting. It is appreciated that all numbers in this description indicating amounts, such as MOA settings, are to be understood as modified by the word "approximately" except as otherwise explicitly indicated.

FIG. 4 illustrates mount 14 secured in a second MOA setting with bore pin 24 disposed in first bore 26. As shown in FIG. 4, mounting piece 20 is slightly angled in the second setting compared to the first setting, with side 38 of mounting piece 20 being elevated with respect to base 18, as indicated in this embodiment by the increased size of gap 40 at side 38 compared to the size of gap 40 at side 36.

Each of the bores of base 18 can correspond to discrete MOA settings. For example, in some embodiments, the various MOA settings of mount 14 can be 10 MOA apart, such as 0, 10, 20, 30, 40, and 50 MOA for a mount including 5 MOA settings. In some embodiments, the various MOA settings of mount 14 can be 20 MOA apart, such as 0, 20, 40, 60, 80, and 100 MOA for a mount including 5 MOA settings. For mounts including only 2 MOA settings, a first setting can, for example, be at 0 MOA and a second setting can, for example, be at 10 MOA or 20 MOA.

Bore pin 24 is sized to removably and securely fit within one or more of the bores of base 18 and one or more corresponding bores of mounting piece 20 to secure mount 14 at a desired MOA setting. As illustrated, for example, in FIGS. 7 and 8, bore pin 24 can, for example, be in the form of a bolt having a threaded portion used to secure bore pin 24 to one or more pieces of mount 14. In some embodiments, a single bore pin 24 can be used in each of the bores of mount 14 to secure mount 14 in any one of the available MOA settings. In some embodiments, different bore pins 24 can be used for different MOA settings. One or more of the bores of base 18 may be circular bores. Other suitable bore shapes can be used.

Pivot pin 22 is sized to removably and securely fit within a pivot bore of base 18 (shown, for example, in FIG. 13) and a pivot bore of mounting piece 20 (shown, for example, in FIG. 18) to allow mounting piece 20 to securely pivot with respect to base 18 around pivot pin 22. Pivot pin 22 can, for example, be in the form of a bolt having a threaded portion. In some embodiments, pivot pin 22 is the same size and shape as bore pin 24. In some embodiments, mount 14 may include a pivoting mechanism that is not in the form of a pivot pin 22 but allows mounting piece 20 to pivot relative to base 18. For example, another type of secure pivoting configuration, such as a suitable flexure hinge, can be used in place of a pivot pin.

Figure 6:
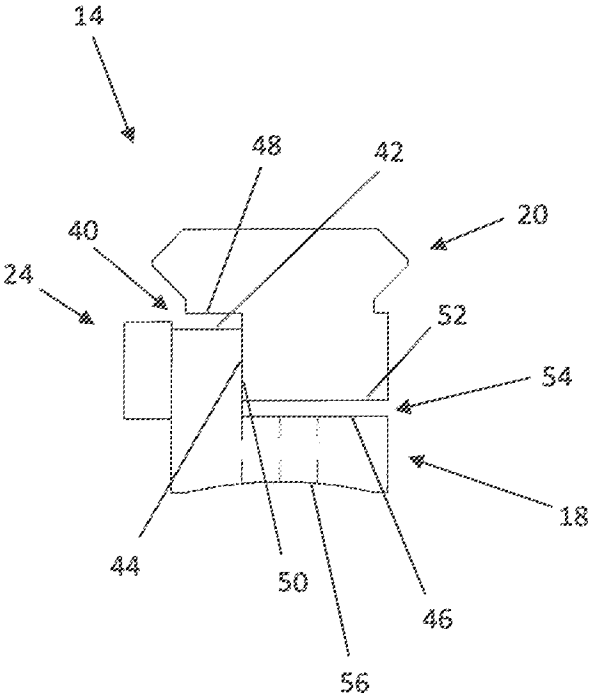
FIG. 6 illustrates a right side view of the mount of FIG. 1 in a second setting.
Figure 5:
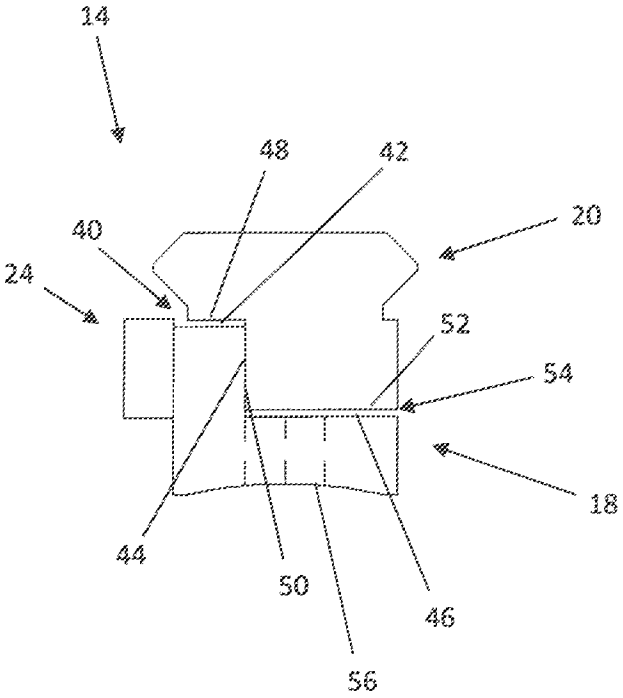
FIG. 5 illustrates a right side view of the mount of FIG. 1 in a first setting.

FIGS. 5 and 6 illustrate right side views of mount 14 in a first setting (FIG. 5) and a second, angled, setting (FIG. 6). These views also illustrate the changes in the size of gap 40 between the first setting and second setting. The embodiment of mount 14 illustrated in FIGS. 5 and 6 includes a substantially L-shaped base 18 with multiple surfaces designed to abut corresponding surfaces of mounting piece 20. That is, base 18 includes surfaces 42, 44, and 46, corresponding to surfaces 48, 50, and 52 of mounting piece 20, with gap 40 formed between surface 42 and 48. Due to the geometry of base 18 and mounting piece 20, a second gap 54 can be formed between surface 46 and surface 52. In order to prevent relative movement in the horizontal direction, surface 44 and 50 can be flush against each other. In addition, bore pin 24 can be designed to secure surfaces 44 and 50 together such that no gap is formed therebetween.

Base 18 can include a bottom surface 56, which can be designed to correspond to a curved surface of weapon 12 in order to secure base 18 to weapon 12. For example, in some embodiments bottom surface 56 may have a similar curve to a curve of an outside surface of a barrel of a firearm. Surface 56 may be another suitable shape based on the shape of weapon 12, or based on other factors.

Figure 8:
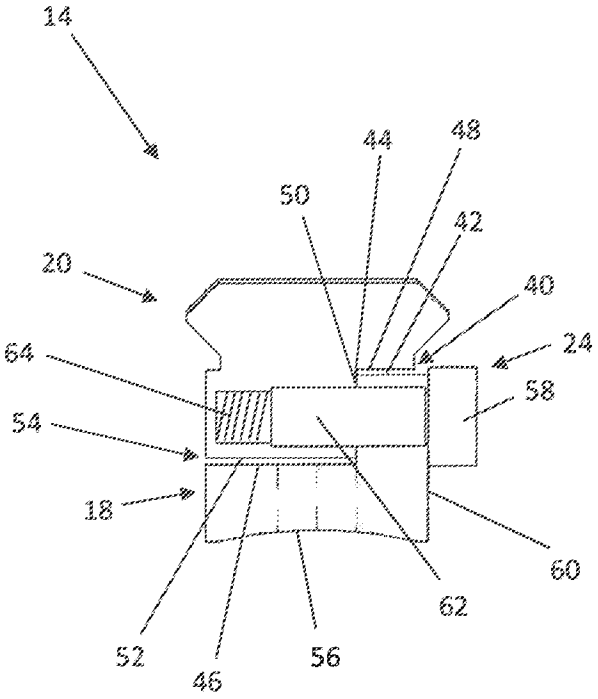
FIG. 8 illustrates a cross-sectional view of the mount of FIG. 1 in a second setting.
Figure 7:
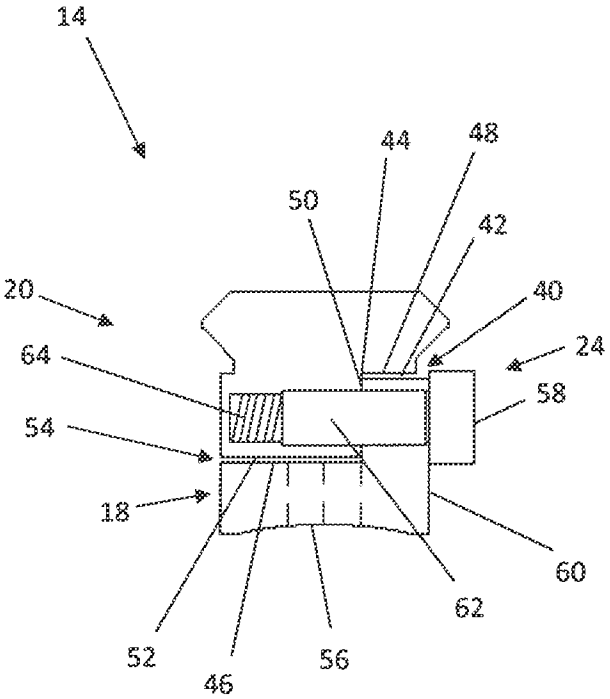
FIG. 7 illustrates a cross-sectional view of the mount of FIG. 1 in a first setting.

FIGS. 7 and 8 illustrate cross-sectional views of mount 14 in a first setting (FIG. 7) and a second setting (FIG. 8). In particular, FIG. 7 illustrates a cross-sectional view of mount 14 along line 7-7 of FIG. 3, and FIG. 8 illustrates a cross-sectional view of mount 14 along line 8-8 of FIG. 3. As shown in FIGS. 7 and 8, it is appreciated that the differences in gap 40 between the first setting and second setting are less pronounced at these cross-sections than the differences between gap 40 as viewed from the right side of mount 14 in FIGS. 5 and 6.

As illustrated in FIGS. 7 and 8, bore pin 24 can include a pin head 58 for engagement with surface 60 of base 18, a pin shaft 62 for engagement with the inner radial surface of one or more of the bores of base 18 and mounting piece 20, and pin threads 64 for removably securing bore pin 24 to corresponding threads of mounting piece 20.

Figure 9:
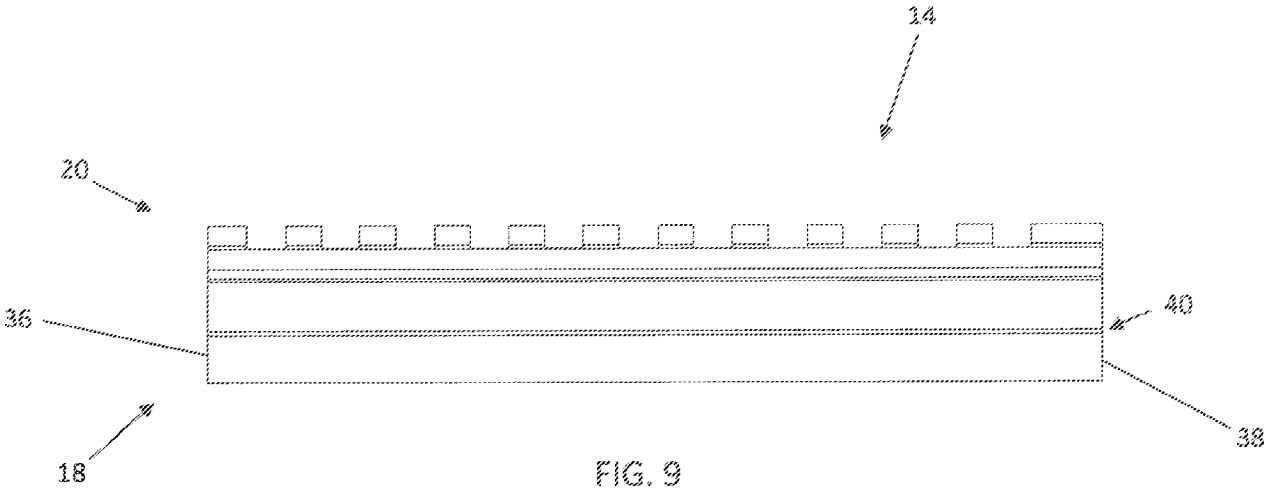
FIG. 9 illustrates a rear view of the mount of FIG. 1 in a first setting.
Figure 10:
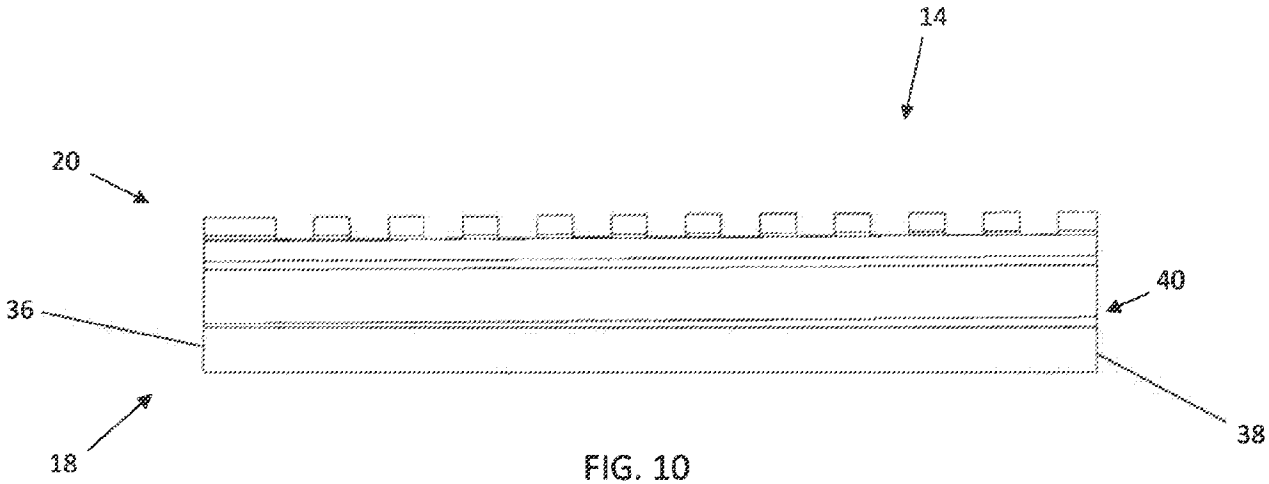
FIG. 10 illustrates a rear view of the mount of FIG. 1 in a second setting.

FIGS. 9 and 10 illustrate rear views of mount 14 in a first setting (FIG. 9) and a second setting (FIG. 10). As shown for example in FIG. 9, in a first setting, mount 14 is at a 0 MOA setting, as indicated in this embodiment by the uniform size of gap 40 between side 36 and side 38. In contrast, and as shown for example in FIG. 10, in a second setting, mount 14 is set at an angle, as indicated in this embodiment by an increase in the size of gap 40 between side 36 and side 38.

Figure 11:
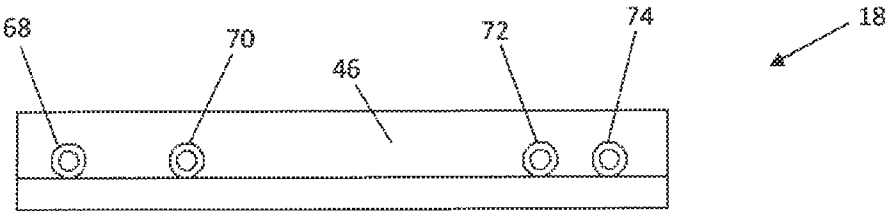
FIG. 11 illustrates a top view of a base of the mount of FIG. 1.
Figure 13:
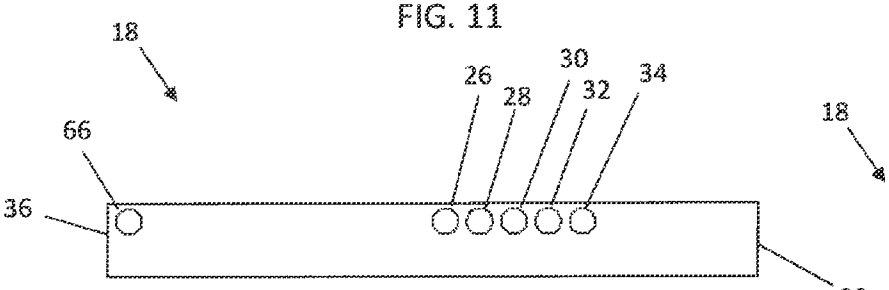
FIG. 13 illustrates a front view of the base of FIG. 11.
Figure 14:
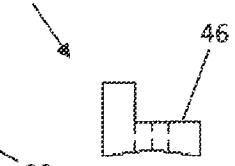
FIG. 14 illustrates a right side view of the base of FIG. 11.
Figure 15:
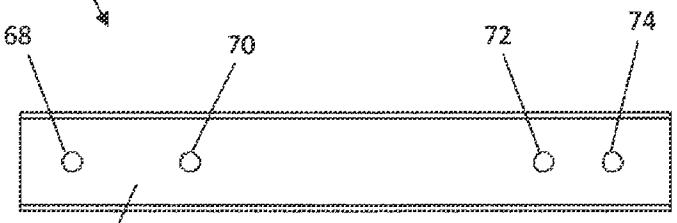
FIG. 15 illustrates a bottom view of the base of FIG. 11.
Figure 12:
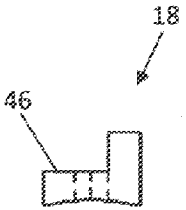
FIG. 12 illustrates a left side view of the base of FIG. 11.

FIGS. 11-15 illustrate various views of base 18. In particular, FIG. 11 illustrates a top view of base 18, FIG. 12 illustrates a left side view of base 18, FIG. 13 illustrates a front view of base 18, FIG. 14 illustrates a right side view of base 18, and FIG. 15 illustrates a bottom view of base 18. As described above, base 18 can include a plurality of bores formed therein, including a pivot bore 66, first bore 26, second bore 28, third bore 30, fourth bore 32, and fifth bore 34. Base 18 can further include one or more mount holes formed in surface 46 for removably securing base 18 to weapon 12. For example, in the embodiment illustrated in FIG. 13, four mount holes, 68, 70, 72, and 74 are formed in surface 46 of base 18. One or more of the mount holes in base 18 may be circular bores. Other suitable hole shapes can be used.

As illustrated in FIG. 13, bores 26, 28, 30, 32, and 34 of base 18 are spaced apart in a longitudinal direction (i.e., substantially horizontally between side 36 and side 38) with different heights relative to the bottom of base 18. The height of each bore relative to the bottom of base 18 can, for example, correspond to discrete MOA settings of mount 14. In some embodiments, the bores are not spaced apart in a longitudinal direction. Instead, the bores can, for example, be spaced apart in a vertical direction corresponding to specific MOA settings. In some embodiments, the bores can be spaced apart in a non-linear direction corresponding to specific MOA settings. In some embodiments, the height of the bores in base 18 can be constant with the height of the corresponding bores in mounting piece being varied to allow for different MOA settings for mount 14. The bores of base 18 extend completely through base 18. In some embodiments, one or more of the bores of base 18 can extend only partially through base 18.

Figure 19:
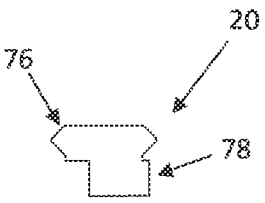
FIG. 19 illustrates a right side view of the mounting piece of FIG. 16.
Figure 16:
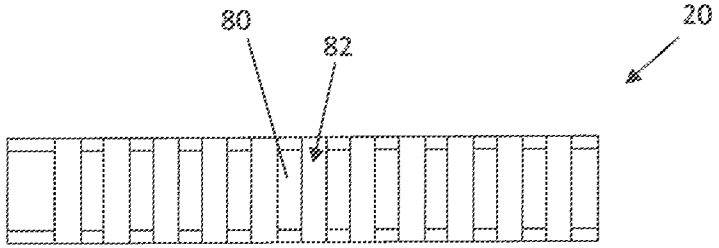
FIG. 16 illustrates a top view of the mounting piece of the mount of FIG. 1
Figure 18:
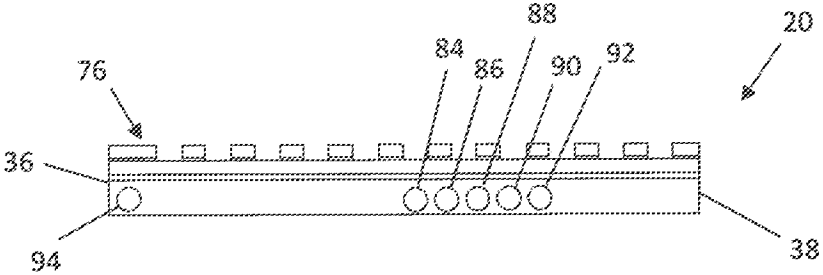
FIG. 18 illustrates a front view of the mounting piece of FIG. 16.
Figure 20:
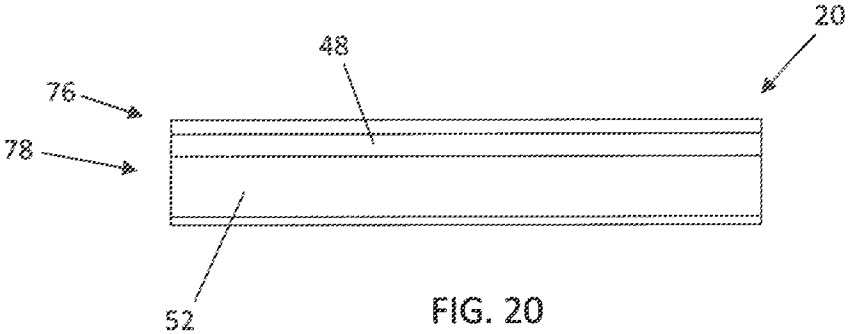
FIG. 20 illustrates a bottom view of the mounting piece of FIG. 16.
Figure 17:
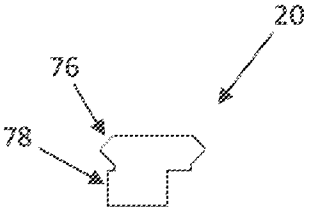
FIG. 17 illustrates a left side view of the mounting piece of FIG. 16.

FIGS. 16-20 illustrate various views of mounting piece 20. In particular, FIG. 16 illustrates a top view of mounting piece 20, FIG. 17 illustrates a left side view of mounting piece 20, FIG. 18 illustrates a front view of mounting piece 20, FIG. 19 illustrates a right side view of mounting piece 20, and FIG. 20 illustrates a bottom view of mounting piece 20. As illustrated in these figures, mounting piece 20 may be in the form of a rail for securing scope 16 to mount 14. In some embodiments, mounting piece 20 may be in the form of another suitable shape for securing scope 16 to mount 14. For example, as described below with respect to FIGS. 21-22, mounting piece 20 may be in the form of a mounting ring for securing scope 16 to mount 14.

The mounting piece 20 illustrated in FIGS. 16-20 includes a rail head 76 and rail body 78. Rail head 76 includes a plurality of protrusions 80 and slots 82 for securing corresponding protrusions and slots of scope 16 to mount 14. As described above, rail body 78 includes one or more bores 84, 86, 88, 90, 92, and 94 corresponding to bores 26, 28, 30, 32, 34, and 66 of base 18.

As illustrated in FIG. 18, bores 84, 86, 88, 90, and 92 of mounting piece 20 are spaced apart in a longitudinal direction (i.e., substantially horizontally between side 36 and side 38) with different heights relative to the bottom of mounting piece 20. The height of each bore relative to the bottom of mounting piece 20 can correspond to discrete MOA settings for mount 14. In some embodiments, the bores are not spaced apart in a longitudinal direction. Instead, the bores can, for example, be spaced apart in a vertical direction corresponding to specific MOA settings. In some embodiments, the bores can be spaced apart in a non-linear direction corresponding to specific MOA settings. In some embodiments, the height of the bores in mounting piece 20 can be constant with the height of the corresponding bores in base 18 being used to allow for different MOA settings for mount 14. The bores of mounting piece 20 extend only partially through mounting piece 20. In some embodiments, one or more of the bores of mounting piece 20 extend completely through mounting piece 20.

Figure 22:
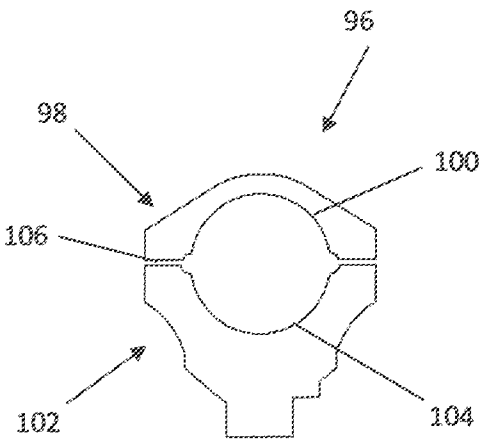
FIG. 22 illustrates a right side view of the mounting piece of FIG. 21.
Figure 21:
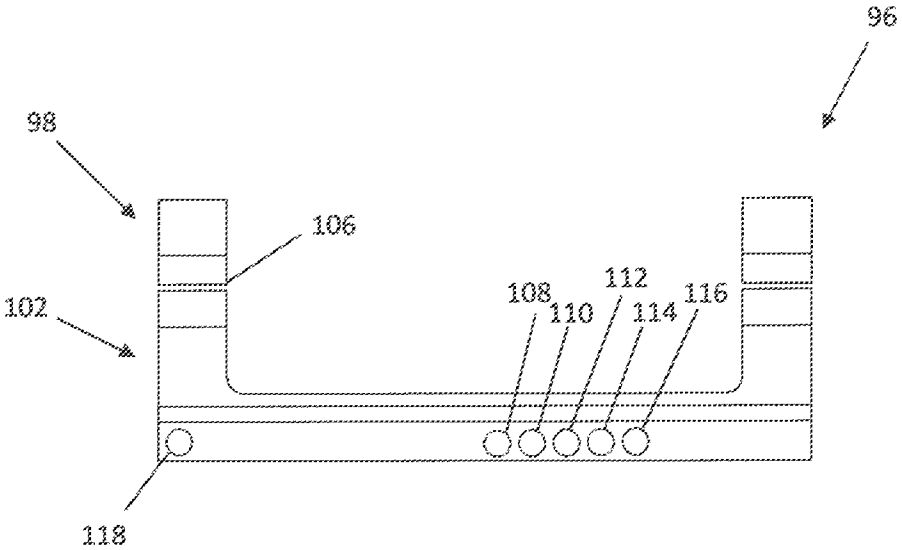
FIG. 21 illustrates a front view of an alternative embodiment of a mounting piece for the mount of FIG. 1

FIGS. 21 and 22 illustrate various views of a second embodiment of a mounting piece 96 for an adjustable scope mount. In particular, FIG. 21 illustrates a front view of mounting piece 96 and FIG. 22 illustrates a right side view of mounting piece 96. As illustrated in these figures, mounting piece 96 can be in the form of a mounting ring for securing scope 16 to a mount incorporating mounting piece 96. For example, mounting piece 96 can be pivotally attached to base 18 to form an adjustable scope mount. Mounting piece 96 can, for example, include an upper piece 98 having a curved inner surface 100 and a lower piece 102 having a curved inner surface 104, the two inner surfaces 100 and 104, when paired together define a cylindrical surface for receiving and securing scope 16. In some embodiments, upper piece 98 and lower piece 102 can, for example, be secured together at a joint 106 via one or more suitable screws, bolts, or other suitable fasteners. A bottom portion of lower piece 102 can, for example, functionally correspond to a lower portion of the various mounting portions described herein. For example, lower piece 102 can include one or more bores 108, 110, 112, 114, 116, and 118 corresponding to bores 84, 86, 88, 90, 92, and 94 of mounting piece 20.

Figure 23:
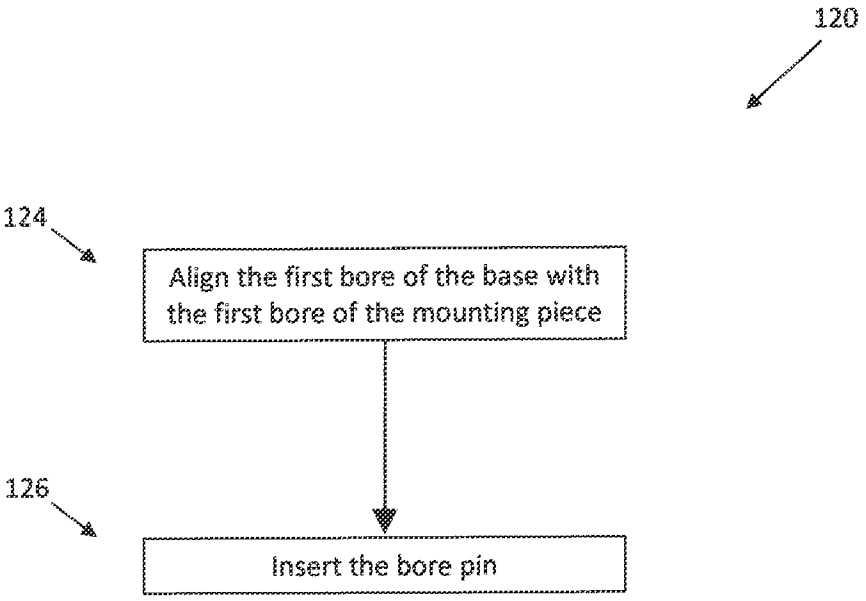
FIG. 23 illustrates a flow chart for a method of using an adjustable scope mount.

FIG. 23 is a flowchart illustrating a method 120 of using an adjustable scope mount for a projectile weapon. Method 120 can include a step of acquiring a scope mount, such as mount 14 for example. For convenience, the description of method 120 references features of mount 14 described herein. However, it is understood that one or more of the alternative mounts described herein may be used with method 120.

Method 120 can include a step 124 of aligning first bore 26 of base 18 with first bore 84 of mounting piece 20 to completely overlap. In embodiments in which mount 14 includes pivot bores 66 and 94, method 120 can include a step of inserting a pivot pin 22 into pivot bore 66 of base 18 and pivot bore 94 of mounting piece 20 to additionally secure mounting piece 20. Pivot pin 22 can be removably secured within mount 14 or it can be substantially irremovably secured within mount 14.

Method 120 can include a step 126 of inserting bore pin 24 into first bore 26 of base 18 and first bore 84 of mounting piece 20 to secure mounting piece 20 at the first MOA setting. In embodiments in which bore pin 24 includes threads 64, bore pin 24 can be further secured to one or both of mounting piece 20 and base 18 by tightening threads 64 against corresponding threads of mounting piece 20 and/or base 18. This securing step can, for example, serve to prevent mounting piece 20 and base 18 from moving relative to each other or losing its position after being bumped or banged. As described above, the first MOA setting can be chosen based on the expected shooting distance, or other factors. If an operator desires to change MOA settings, he or she can unscrew bore pin 24, remove pin from first bore 26, place bore pin 24 in another bore of base 18 and tighten threads 64 of bore pin 24 against corresponding threads of mounting piece 20 and/or base 18.

In embodiments in which pivot pin 22 include threads, method 120 can include further securing pivot pin 22 to one or both of mounting piece 20 and base 18 by tightening the threads of pivot pin 22 against corresponding threads of mounting piece 20 and/or base 18.

In some embodiments, method 120 can include a step of mounting base 18 to weapon 12. Base 18 can be mounted to weapon 12 using any suitable technique, such as, for example, a suitable screw, bolt, and/or adhesive. Base 18 can, for example, be removably secured to weapon 12, or it can be substantially irremovably secured to weapon 12. In some embodiments, base 18 can be integral with weapon 12, and can, for example, be an unremovable projection extending from a barrel of a firearm.

In some embodiments, method 120 can include a step of mounting the mounting piece 20 to scope 16. Mounting piece 20 can be mounted to scope 16 using any suitable technique, such as, for example, a suitable screw, bolt, and/or adhesive. Mounting piece 20 can, for example, be removably secured to scope 16, or it can be substantially irremovably secured to scope 16. In some embodiments, mounting piece 20 can be integral with scope 16, and can, for example, be an unremovable projection extending from a housing of scope 16.

The steps described herein with respect to method 120 may be performed in any suitable order. As but one example, a step of mounting base 18 to weapon 12 can be performed before or after a step of inserting bore pin 24 into base 18 and mounting piece 20.

Figure 24:
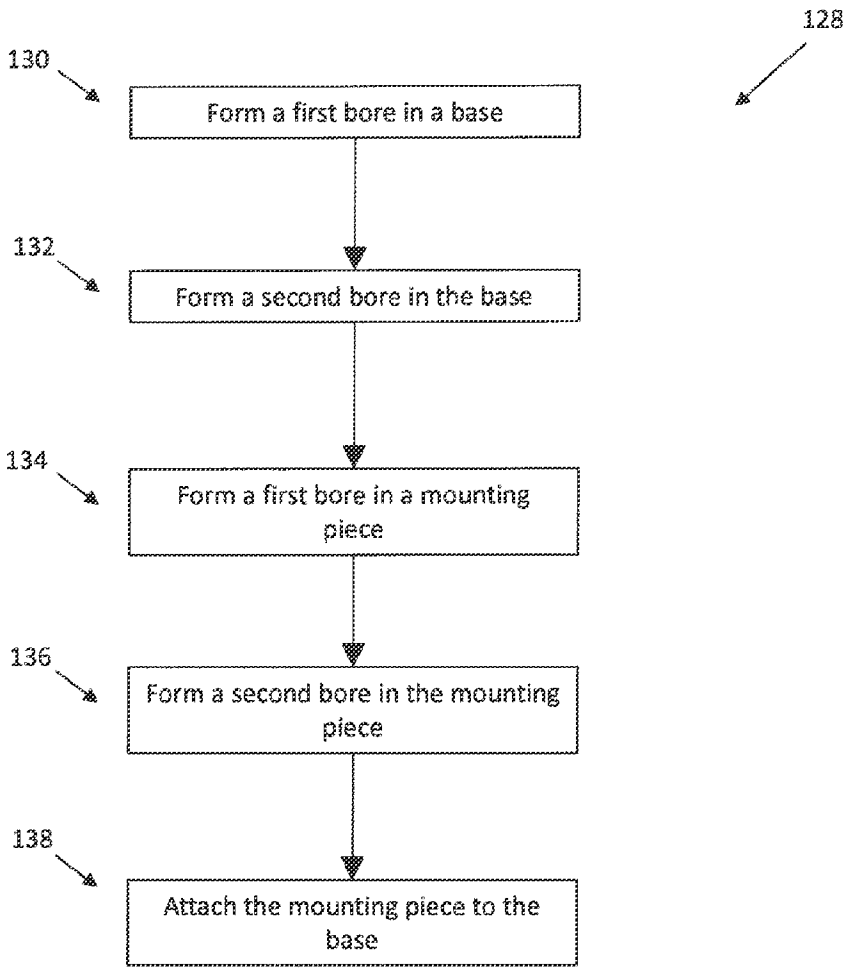
FIG. 24 illustrates a flow chart for a method of manufacturing an adjustable scope mount.

FIG. 24 is a flowchart illustrating a method 128 of manufacturing an adjustable scope mount for a projectile weapon system. For convenience, the description of method 128 references features of mount 14 described herein. However, it is understood that one or more alternative mounts described herein may be used with method 128.

Method 128 can include steps 130 and 132 of forming first bore 26 and second bore 28 in base 18. In these steps, first bore 26 can be formed such that it is positioned near the middle of base 18 and second bore 28 can be formed such that it is positioned towards an end of base 18. It is appreciated that first bore 26 and second bore 28 can be formed using a single operation that forms both bores simultaneously. Alternatively, bores 26 and 28 may be formed one after another in any desired order. It is appreciated that a similar manufacturing operation can be used for mounts containing additional bores.

Method 128 can include step 134 and 136 of forming first bore 84 in mounting piece 20 that is substantially the same size as first bore 26 of base 18 (step 134) and forming second bore 86 in mounting piece 20 that is substantially the same size as second bore 86 of base 18 (step 136). It is appreciated that first bore 84 and second bore 86 may be formed using a single operation that forms both bores simultaneously. Alternatively, the bores may be formed one after another in any desired order. It is appreciated that a similar manufacturing operation can be used for mounts containing additional bores.

First bore 84 of mounting piece 20 and second bore 86 of mounting piece 20 are positioned such that when first bore 26 of base 18 and first bore 84 of mounting piece 20 are aligned to completely overlap, mounting piece 20 is positioned at a first MOA setting. Second bore 86 of base 18 and second bore 86 of mounting piece 20 are positioned such that when second bore 28 of base 18 and second bore 86 of mounting piece 20 are aligned to completely overlap, mounting piece 20 is positioned at a second MOA setting.

Method 128 can include a step of forming pivot bore 66 in base 18 and forming pivot bore 94 in mounting piece 20. It is appreciated that pivot bores 66 and 94 can be formed using a single operation that forms both bores simultaneously. Alternatively, the bores may be formed one after another in any desired order.

Method 128 can include a step 138 of attaching mounting piece 20 to base 18 such that mounting piece 20 can pivot with respect to base 18 to allow mount 14 to be adjusted to different MOA settings. For example, step 138 can include inserting pivot pin 22 within pivot bore 66 of base 18 and pivot bore 94 of mounting piece 20. As described above, in some embodiments, mount 14 may include a pivoting mechanism that is not in the form of a pivot pin 22. For example, in some embodiments, another type of secure pivoting configuration, such as a suitable flexure hinge can be used in place of a pivot pin.

The steps described herein with respect to method 128 may be performed in any suitable order. As but one example, the step of forming bores in base 18 can be performed before or after the step of forming bores in mounting piece 20.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

While the embodiments presented herein have been set forth and described in detail for the purposes of making a full and complete disclosure of the subject matter thereof, such disclosure is not intended to be limiting in any way with respect to the true scope of this invention as the same is set forth in the appended claims.

The invention claimed is:

1. An adjustable scope mount for a projectile weapon, the mount comprising:

a substantially L-shaped base configured to be attached to the projectile weapon, the base having a first surface and a second surface, the base including a first bore and a second bore, wherein the first and second bores of the base create openings that extend through the base from the first surface of the base to the second surface of the base; and a substantially L-shaped support configured to support a scope on the projectile weapon, the support corresponding to the base and pivotally attached to the base, the support including a first blind bore that is substantially the same size as the first bore of the base and a second blind bore that is substantially the same size as the second bore of the base, wherein the first and second blind bores of the support each create only one opening at a first surface of the support, wherein the first bore of the base and the first blind bore of the support are positioned such that when the opening at the second surface of the first bore of the base and the opening at the first surface of the first blind bore of the support are aligned to completely overlap, the support is positioned at a first minute of angle setting, and wherein the second bore of the base and the second blind bore of the support are positioned such that when the opening at the second surface of the second bore of the base and the opening at the first surface of the second blind bore of the support are aligned to completely overlap, the support is positioned at a second minute of angle setting.

2. The scope mount of claim 1, further comprising:

a bore pin sized to removably and securely fit within the first bore of the base and the first blind bore of the support to secure the support at a first minute of angle setting or within the second bore of the base and the second blind bore of the support to secure the support at a second minute of angle setting.

3. The scope mount of claim 2, wherein the bore pin includes screw threads sized to engage with each of the first and second blind bores to secure the bore pin to the base.

4. The scope mount of claim 1, wherein the base includes a pivot bore and the support includes a pivot bore, the scope mount further comprising:

a pivot pin sized to securely fit within the pivot bore of the base and the pivot bore of the support to allow the support to securely pivot with respect to the base around the pivot pin.

5. The scope mount of claim 1, wherein the base includes a third bore, wherein the support includes a third bore that is substantially the same size as the third bore of the base, and wherein the third bore of the base and the third bore of the support are positioned such that when the third bore of the base and the third bore of the support are aligned to completely overlap, the support is positioned at a third minute of angle setting.

6. The scope mount of claim 1, wherein the base includes three additional bores, wherein the support includes three additional bores corresponding to the the three additional bores of the base, each of the three additional bores of the support being substantially the same size as a corresponding bore of the base, and wherein each of the bores of the base and the corresponding bores of the support are positioned such that when corresponding bores are aligned to completely overlap, the support is positioned at different minute of angle settings.

7. The scope mount of claim 1, wherein the first and second bores of the base are spaced apart in a longitudinal direction.

8. The scope mount of claim 1, wherein the first bore of the base is a circular bore.

9. The scope mount of claim 1, wherein the first minute of angle setting is 0 and the second minute of angle setting is 10.

10. The scope mount of claim 1, wherein the first minute of angle setting is 0 and the second minute of angle setting is 20.

11. A projectile weapon system comprising:

a scope mount according to claim 1; and a firearm.

12. A method of using an adjustable scope mount for a projectile weapon, the adjustable scope mount including a substantially L-shaped base configured to be attached to the projectile weapon, the base having a first surface and a second surface, the base including a first bore and a second bore, wherein the first and second bores of the base create openings that extend through the base from the first surface of the base to the second surface of the base, and a substantially L-shaped support configured to support a scope on the projectile weapon, the support corresponding to the base and pivotally attached to the base, the support including a first blind bore that is substantially the same size as the first bore of the base and a second blind bore that is substantially the same size as the second bore of the base, wherein the first and second blind bores of the support each create only one opening at a first surface of the support, wherein the first bore of the base and the first blind bore of the support are positioned such that when the opening at the second surface of the first bore of the base and the opening at the first surface of the first blind bore of the support are aligned to completely overlap, the support is positioned at a first minute of angle setting, and wherein the second bore of the base and the second blind bore of the support are positioned such that when the opening at the second surface of the second bore of the base and the opening at the first surface of the second blind bore of the support are aligned to completely overlap, the support is positioned at a second minute of angle setting, and a bore pin sized to removably and securely fit within the first bore of the base and the first blind bore of the support to secure the support at the first minute of angle setting or within the second blind bore of the base and the second bore of the support to secure the support at the second minute of angle setting, the method comprising:

aligning the first bore of the base with the first blind bore of the support to completely overlap; and inserting the bore pin into the first bore of the base and the first blind bore of the support to secure the support at the first minute of angle setting.

13. The method of claim 12, further comprising:

mounting the base to a projectile weapon.

14. The method of claim 12, further comprising:

mounting a scope to the support.

15. A method of manufacturing an adjustable scope mount for a projectile weapon, the method comprising:

forming a first bore in a substantially L-shaped base configured to be attached to the projectile weapon, the base having a first surface and a second surface, wherein the first bore creates an opening extending through the base from the first surface of the base to the second surface of the base;

forming a second bore in the base, wherein the second bore creates an opening extending through the base from the first surface of the base to the second surface of the base;

forming a first blind bore in a substantially L-shaped support configured to support a scope on the projectile weapon, the support corresponding to the base, wherein the first blind bore is substantially the same size as the first bore of the base and creates only one opening at a first surface of the support;

forming a second blind bore in the support that is substantially the same size as the second bore of the base and creates only one opening at the first surface of the support; and attaching the support to the base such that the support can pivoted with respect to the base to allow the scope mount to be adjusted to different minute of angle settings, wherein the first bore of the base and the first blind bore of the support are positioned such that when the opening at the second surface of the first bore of the base and the opening at the first surface of first blind bore of the support are aligned to completely overlap, the support is positioned at a first minute of angle setting, and wherein the second bore of the base and second blind bore of the support are positioned such that when the opening at the second surface of the second bore of the base and the opening at the first surface of the second blind bore of the support are aligned to completely overlap, the support is positioned at a second minute of angle setting.

16. The method of claim 15, wherein the first bore of the base is positioned near the middle of the base.

17. The method of claim 15, wherein the second bore of the base is positioned towards an end of the base.

18. The method of claim 15, further comprising:

forming a pivot bore in the base;

forming a pivot bore in the support; and inserting a pivot pin within the pivot bore of the base and the pivot bore of the support to allow the support to securely pivot with respect to the base around the pivot pin.

19. The method of claim 18, wherein the pivot bore of the base is positioned at an end of the base.

* * * * *